United States Patent [19]

Takasugi

[11] Patent Number: 4,681,243

[45] Date of Patent: Jul. 21, 1987

[54] CARTRIDGE WITH PLUG OPENING MECHANISM

[75] Inventor: Mitsuo Takasugi, Yokohama, Japan

[73] Assignee: Colpo Co., Ltd., Tokyo, Japan

[21] Appl. No.: 708,058

[22] Filed: Mar. 4, 1985

[30] Foreign Application Priority Data

Mar. 7, 1984 [JP] Japan ..... 59-43511
Mar. 7, 1984 [JP] Japan ..... 59-43512

[51] Int. Cl.[4] ..... B67B 7/24

[52] U.S. Cl. ..... 222/83; 222/81; 222/85; 222/541

[58] Field of Search ..... 222/81, 83, 83.5, 85, 222/86, 541

[56] References Cited

U.S. PATENT DOCUMENTS

| | | | |
|---|---|---|---|
| 1,952,840 | 3/1934 | Claus et al. | 222/85 |
| 2,028,175 | 1/1936 | Waite | 222/83 |
| 2,073,292 | 3/1937 | Waite et al. | 222/81 |
| 3,425,598 | 2/1969 | Kobernick | 222/541 |
| 3,831,814 | 8/1974 | Butler | 222/81 |
| 4,022,258 | 5/1977 | Steidley | 222/81 X |
| 4,483,464 | 11/1984 | Nomura | 222/83 |

*Primary Examiner*—Joseph J. Rolla
*Assistant Examiner*—Jay I. Alexander
*Attorney, Agent, or Firm*—Browdy and Neimark

[57] ABSTRACT

A cartridge which discharges a filler such as a bonding agent by pressing directly by a finger or by an exclusive discharger with a plug opening function. A plug member is secured fixedly to the head of a cartridge body, a nozzle is screwed to or engaged with the plug member. The nozzle has a needle or cutting teeth at the bottom, to be deeply screwed or pressed to the plug member to open the plug.

5 Claims, 18 Drawing Figures

FIG.4
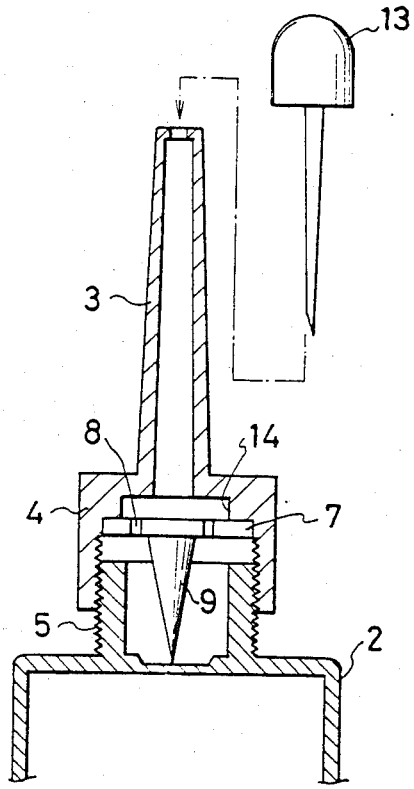
FIG.5
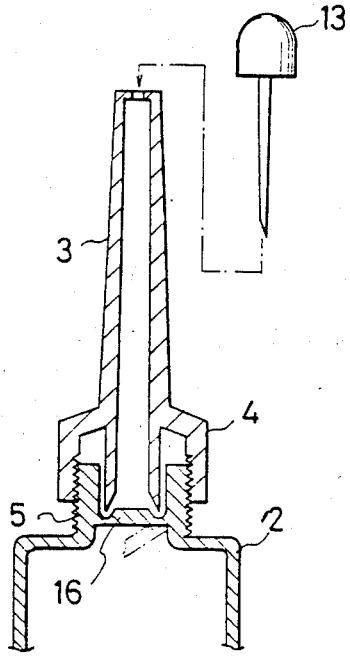
FIG. 6b
FIG. 6a
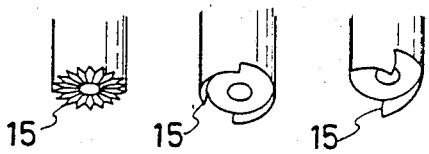
FIG. 6c

FIG.7
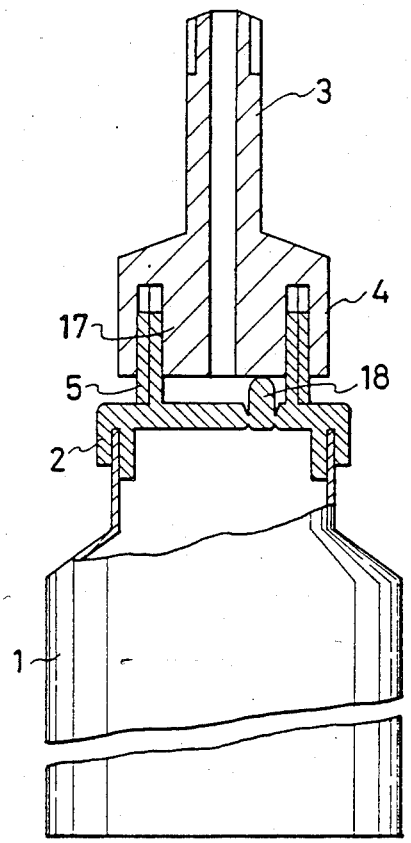
FIG.8a
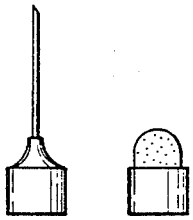
FIG.8b
FIG.8c
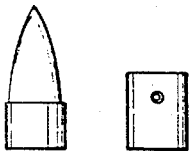
FIG.8d

CARTRIDGE WITH PLUG OPENING MECHANISM

BACKGROUND OF THE INVENTION

1. Field of the Invention

The present invention relates to a cartridge for containing a filler such as a bonding agent to discharge the filler as it is or by a discharger with a plug opening mechanism.

2. Description of the Prior Art

There were heretofore various types of conventional cartridges which filled bonding agents, medicines or nutrients in plastic or glass vessels. Since the cartridge did not have simple plug opening mechanism, the content tends to be scattered, when a child operates the cartridge, around to his body or a floor to deteriorate the body or the floor. In case of the glass vessel, pulverized pieces of the glass might enter the vessel in danger.

SUMMARY OF THE INVENTION

An object of the present invention is to provide a cartridge with a plug opening mechanism which is capable of simply and reliably opening a plug without scattering the content to any people.

Another object of the present invention is to provide a cartridge with a plug opening mechanism which does not leak the content after the plug is opened.

Still another object of the present invention is to provide a cartridge with a plug opening mechanism which is capable of being utilized as a drink absorbing vessel without separately preparing a straw.

Other and further objects, features and advantages of the invention will appear more fully from the following description.

BRIEF DESCRIPTION OF THE DRAWINGS

FIG. 4 is a longitudinal sectional view of the essential portion of another embodiment of a cartridge with a plug opening mechanism according to the present invention;

FIG. 5 is a longitudinal sectional view of the essential portion of still another embodiment of a cartridge with a plug opening mechanism according to the present invention;

FIGS. 6(*a*)–6(*c*) are views showing examples of the shape of cutting teeth of the drill;

FIG. 7 is a longitudinal sectional view of the essential portion of still another embodiment of a cartridge with a plug opening mechanism according to the invention;

FIGS. 8(*a*)–8(*d*) are views showing examples of the shape of an attachment used for the cartridge; and FIGS. 9 to 13 are respectively longitudinal sectional views of the essential portions of still other embodiments of a cartridge with a plug opening mechanism according to the present invention.

DETAILED DESCRIPTION OF THE PREFERRED EMBODIMENTS

Figure 1:
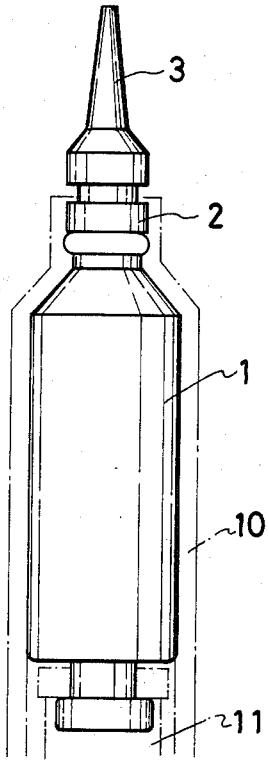
FIG. 1 is a view of the external appearance of an embodiment of a cartridge with a plug opening mechanism according to the present invention.
Figure 2:
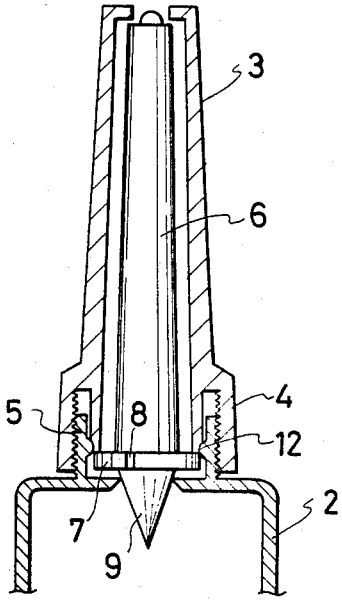
FIG. 2 is a longitudinal sectional view of the essential portion of the cartridge.
Figure 3:
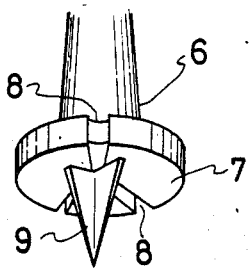
FIG. 3 is a view showing the construction of a plug with a drill.

The present invention is a cartridge with a plug opening mechanism which comprises a plug member fixedly secured to a head of a cartridge body, and a nozzle having a function of opening the plug member by pressing itself into the plug member from above or screwing itself into the plug member. The embodiments of the present invention will be described with reference to the accompanying drawings. An embodiment of the cartridge with a plug opening mechanism of the invention will be first described with reference to FIGS. 1 to 4. A plug member 2 is covered on the head of the cartridge 1, in which a bonding agent or the like is filled, a nozzle 3 is screwed into or engaged with the member 2. The nozzle 3 has a hollow shape, and is formed at the lower portion with a seating portion 4 which is gradually increased in diameter toward the lower portion. The seating portion 4 is formed in double annular wall shape in such a manner that female threads are formed on the inner wall of the outer wall. A male thread cylinder 5 of cylindrical shape which is formed at the head of the member 2 is screwed to the female threads of the seating portion 4. A plug 6 with a drill which extends along the hollow portion of the nozzle 3 is movably inserted into the nozzle 3 with a sufficient gap to the periphery thereof. The top surface of the plug 6 with the drill can close in size the opening of the nozzle 3, and a collar 7, at which a plurality of notches 8 are formed at the periphery, is formed at the lower portion of the plug 6. A drill 9 of triangular, square or conical shape is formed on the bottom of the collar 7. As shown in FIG. 4, the portion of the male thread cylinder 5, with which the end of the drill 9 is contacted with the inner bottom of the cylinder 5, is reduced in thickness. An annularly projecting portion 12 which is slightly narrower than the collar 7 is formed on the inner wall of the cylinder 5. In the embodiment shown in FIG. 4, there is not formed an inner wall at the seating portion 4 nor an upper portion from the collar 7 of the plug 6 with the drill, but a leg is provided to be inserted into the nozzle 3 in a cap 13.

When the tail of a piston 11 is pressed by a discharger, i.e., by charging it into a cylinder 10 of the cartridge 1 or by pressing the side surface of the cartridge 1 to discharge the content of the cartridge 1. The plug of the cartridge 1 can be opened by holding and turning the nozzle 3. In other words, before turning the nozzle 3, the end of the drill 9 is disposed above the inner bottom of the cylinder 5, and the nozzle 3 is shallowly screwed to the top of the cylinder 5. When the nozzle 3 is turned, the nozzle 3 is deeply screwed into the cylinder 5, and the inner wall of the seating portion 4 is then pressed to the collar 7, thereby pressing it toward the lower portion of the projecting portion 12. Thus, the drill 9 disposed on the thin-walled portion of the inner bottom of the cylinder 5 is moved downwardly to press and collapse it. In this manner, the content or filler in the cartridge 1 is flowed through the notches 8 into the nozzle 3, and fed through the gap between the inner wall of the nozzle 3 and the plug 6 with the drill toward an exit at the end of the nozzle 3. When the nozzle 3 is screwed in the deepest position, the exit at the end of the nozzle 3 is closed by the top surface of the plug 6 with the drill, and the content is not yet discharged. When the nozzle 3 is then unscrewed, the plug 6 with the drill is not raised since the collar 7 is retained at the projecting portion 12. Thus, the exit of the nozzle 3 is opened to become the state capable of discharging the content. After discharging the content, when the nozzle 3 is then screwed in, the exit of the nozzle 3 is closed. Therefore, the content in the cartridge 1 is not leaked. In the embodiment shown in FIG. 4, when the nozzle 3 is screwed, a stepped portion 14 inside the seating portion 4 presses the collar 7, and the drill 9 collapses the thin portion of the top of the member 2. After discharging the content from the cartridge 1, the cap 13 is covered on the nozzle 3.

Another embodiment of a cartridge with a plug opening mechanism of the invention is shown in FIG. 5. A nozzle 3 of this cartridge 1 has cutting teeth 15 on the lower ends of the inner wall. FIGS. 6(*a*), 6(*b*) and 6(*c*) show examples of the shapes of the cutting teeth 15. The inner bottom 16 of the cylinder 5 is reduced in thickness at the periphery, and to be contacted with the cutting teeth 15.

In this case, when the nozzle 3 is deeply screwed in case that the plug is opened, the cutting teeth 15 cut the peripheral thinned portion of the inner bottom 16 while turning, thereby pressing and opening the inner bottom 16. After discharging the content of the cartridge 1, a cap 13 is covered.

Still another embodiment of a cartridge with a plug opening mechanism of the invention is shown in FIG. 7. The inner wall 17 of a seating portion 4 is formed in increased thickness in such a manner that the bottom is flat. A pressing plug 18 which is reduced in thickness at the periphery is projected upwardly from the inner bottom of the cylinder 5. As shown in FIG. 8, an attachment is detachably engaged with the exit of the nozzle 3. The attachment may be formed in a needle shape as shown in FIG. 8(*a*), of a sponge as shown in FIG. 8(*b*), of a brush as shown in FIG. 8(*c*) and in a spray head shape as shown in FIG. 8(*d*).

In the embodiment described above, when the nozzle 3 is screwed to the deepest position, the bottom of the inner wall 17 is pressed to the plug 18 to drop the plug 18, thereby opening it. In this case, when the nozzle 3 is screwed to the deepest position, i.e., when the bottom of the inner wall 17 is contacted with the inner bottom of the cylinder 5, the opening is closed. Therefore, when the content of the cartridge is discharged, the nozzle 3 is raised, while after the content of the cartridge is discharged, the nozzle 3 is fully screwed.

Still another embodiments of the invention are shown in FIGS. 9 and 10. In the embodiments, when the nozzle 3 is deeply screwed, the plug is opened, the opening is released by raising the nozzle 3, and closed when the nozzle is deeply screwed to the deepest position.

Figure 11:
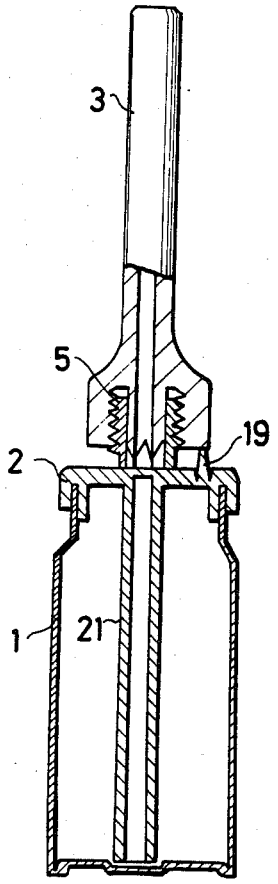
Figure 12:
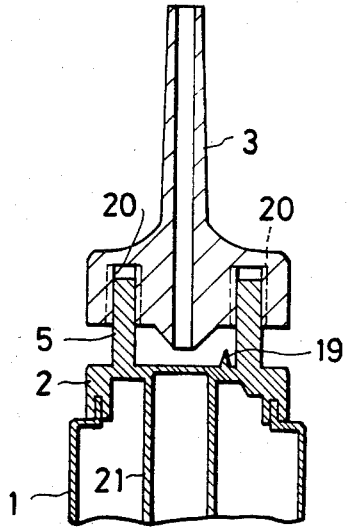
Figure 13:
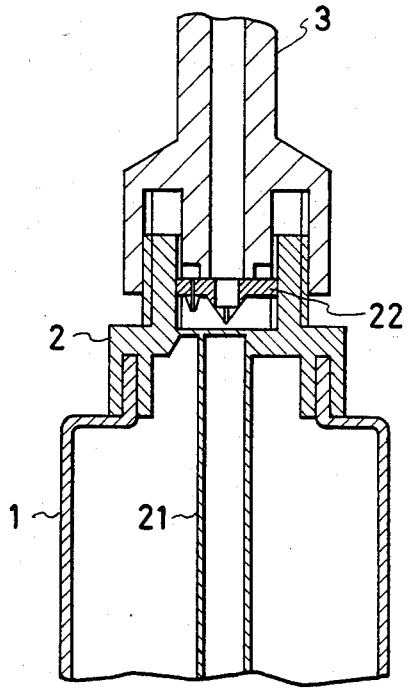

Still other embodiments of the invention are shown in FIGS. 11 to 13. These embodiments are devised mainly as a content absorbing vessel for medicines, nutrients or drinks. When the nozzle 3 is screwed, the plug is opened. Simultaneously, an air hole is also formed. In this case, the construction of the nozzle 3 may be in the same manner as described in the embodiments described above, but the end of the nozzle 3 is formed in the shape to be readily absorbed in a mouth. A pressing plug 19 which is projected upwardly is formed in the same manner as the plug 18 at the plug member 2. The plug 19 may be formed outside a male thread cylinder 5 as shown in FIG. 11, or inside the cylinder 5 as shown in FIG. 12. When the plug 19 is formed inside the cylinder 5, it is necessary to form an air introducing slot 20 at the contacting portion of the seating portion 4 of the nozzle and the cylinder 5. A sucking tube 21 which extends to the bottom of the cartridge 1 is mounted at the plug member 2. In the embodiments described above, when the nozzle 3 is deeply screwed, the plug is opened by cutting teeth formed on the bottom of the inner wall, and when the plug 19 is pressed and collapsed by the bottom of the seating portion, and an air hole is formed. Thus, the content of the cartridge can be readily sucked from the nozzle 3.

FIG. 13 shows still another embodiment of the case that an air hole is formed simultaneously when the plug is opened. In this embodiment, a disc 22 with a drill which moves downwardly in the cylinder 5 by the inner wall of the seating portion is mounted thereat. The disc 22 with the drill has a large needle for opening the top of a suction tube 21 and a small needle for opening the outside of the tube 21. In this case, when the nozzle 3 is deeply screwed, the disc 22 is depressed by the inner wall of the seating portion, and the sucking tube is opened by two needles.

As may apparently widely different embodiments of this invention may be without departing from the spirit and scope thereof, it is to be understood that the invention is not limited to the specific embodiments thereof except as defined in the appended claims.

What is claimed is:

1. A cartridge containing a dispensable material and having a dispensing end with a plug opening mechanism, comprising:

a plug member mounted on the dispensing end of the cartridge, and having an annular male connecting region at its upper portion;

a hollow nozzle member having a lower end and an upper apertured end, said lower end having a seat portion formed as double annular walls and including a threaded female screw on the inner side of the outer wall of the double annular walls, said seat portion being secured to the plug member by mounting said female screw on the male connecting region; and a drill holding member extending within the hollow portion of the nozzle, said drill holding member having an upper end portion for closing the aperture at the upper end of the nozzle, and further having, at a lower end portion thereof, an annular collar having a plurality of spaced, radially extending notches, said collar supporting a downwardly depending drill.

2. The cartridge with a plug opening mechanism as claimed in claim 1, wherein the male connecting region is reduced in thickness at an inner bottom surface.

3. A cartridge with a plug opening mechanism as claimed in claim 1, wherein a projection is formed at an inner periphery of the male connecting region for engagement with said collar.

4. A cartridge with a plug opening mechanism as claimed in claim 1, wherein a projection of hemi-spherical shape is formed on the upper end portion of the drill holding member.

5. A nozzle adapted for selectively opening a plug member on the dispensing end of a cartridge filled with a dispensable material, the plug member including a puncturable surface surrounded by an annular threaded collar, the nozzle comprising:

a hollow cylindrical first member having at one end means for threadedly engaging the collar of said plug member, and having at the opposite end an apertured cover, and a cylindrical second member contained within said hollow first member and having a shaft with a first end and a second end, said shaft first end being formed with a drill member for piercing said plug member puncturable surface, and an annular flange positioned between said shaft and said drill member, and said second end having means for blocking the aperture of said first member cover, said first member engaging means including annular means, disposed radially inwardly of said annular collar, for pressing against said flange and urging said drill member into piercing engagement with said puncturable surface when said engaging means is threadedly engaged with said plug member threaded collar; and wherein said annular flange comprises a plurality of circumferentially spaced notches disposed about the periphery thereof, said notches permitting the flow of said dispensable material from said container through said first member and out of said apertured cover to a point of use when said first member is partially unthreaded from said plug member collar after said puncturable surface has been pierced.

* * * * *